US006327956B1

(12) United States Patent
Rink

(10) Patent No.: US 6,327,956 B1
(45) Date of Patent: Dec. 11, 2001

(54) HYDRAULIC CONTROL WITH IMPROVED REGENERATIVE VALVE APPARATUS AND METHOD

(76) Inventor: Scott R. Rink, 543 Lawn Ridge St. SE., Huron, SD (US) 57350

( * ) Notice: Subject to any disclaimer, the term of this patent is extended or adjusted under 35 U.S.C. 154(b) by 0 days.

(21) Appl. No.: 09/146,510

(22) Filed: Sep. 3, 1998

Related U.S. Application Data

(60) Provisional application No. 60/057,888, filed on Sep. 3, 1997.

(51) Int. Cl.[7] ..... F15B 11/024
(52) U.S. Cl. ..... 91/28; 91/436; 91/437
(58) Field of Search ..... 91/28, 436, 437

(56) References Cited

U.S. PATENT DOCUMENTS

| | | | |
|---|---|---|---|
| 3,757,680 | 9/1973 | Williams . | |
| 3,844,209 | 10/1974 | Allbritton . | |
| 4,188,876 | 2/1980 | Graves . | |
| 4,216,702 | 8/1980 | Brundidge et al. . | |
| 4,426,928 | 1/1984 | Woods et al. . | |
| 4,467,716 | 8/1984 | Woods et al. . | |
| 4,840,111 | 6/1989 | Garnjost . | |
| 5,065,664 * | 11/1991 | Ohta et al. | 91/436 |
| 5,218,897 | 6/1993 | Shirai et al. . | |
| 5,233,909 | 8/1993 | Von Hoene . | |
| 5,370,038 | 12/1994 | Poppe et al. . | |
| 5,415,076 | 5/1995 | Krone et al. . | |
| 5,592,876 | 1/1997 | Son . | |

* cited by examiner

*Primary Examiner*—F. Daniel Lopez

(57) ABSTRACT

An improved method and apparatus utilizing regenerative hydraulic control principles are disclosed. A regenerative valve is operatively connected in a hydraulic control circuit with a primary hydraulic cylinder for controlling the speed at which the piston and attached rod of the hydraulic cylinder operatively move. The regenerative valve and control apparatus and method control speed of operation of the primary hydraulic cylinder when moving in both its power and its return strokes, to significantly reduce the cylinder's cycle time. A unique regenerative valve configuration enables significantly enhanced volumes of hydraulic fluid to be transferred during a regeneration cycle between the rod and blind sides of the hydraulic cylinder.

19 Claims, 4 Drawing Sheets

HYDRAULIC CONTROL WITH IMPROVED REGENERATIVE VALVE APPARATUS AND METHOD

CROSS REFERENCE TO RELATED APPLICATION

This application claims the benefit of U.S. Provisional Application No. 60/057,888, filed Sep. 3, 1997.

FIELD OF THE INVENTION

This invention related generally to hydraulic control systems, and more particularly to such a system having a unique regenerative valve apparatus and method.

BACKGROUND OF THE INVENTION

There are many hydraulic control applications where it is desirable to significantly reduce the time taken to move the primary force producing hydraulic piston of the system in one or both directions of its operative travel. The need can become very significant in physical systems having hydraulic cylinder prime movers that are very large, such as in automobile crushing systems. Depending on their particular designs, such systems may utilize very large prime mover cylinders connected to operate the crushing ram with, for example, bore diameters of 10 to 12 inches and piston strokes from 90 to 100 inches. In such systems, it is desirable not only to crush the automobile in a relatively short period of time, but to then rapidly return the crushing ram to its initial position for the start of the next crushing operation.

Regenerative hydraulic circuit principles have been used to reduce the cycle time of prime mover hydraulic cylinders. The general principal involved in a regenerative circuit is that special valving is used to connect the rod end of the prime mover cylinder with its blind or cap end in a manner so as to increase the rate of travel of the piston. For example, if it is desired to increase the piston travel speed in the primary working direction of the piston, from its blind end toward its rod end, the regenerative network would direct hydraulic system oil that would normally flow to the system tank or reservoir, from the piston's rod end, to supplement the pumped oil being supplied to the piston's blind end—causing the piston to advance at an increased rate of speed toward the rod end.

During a regenerative process, in essence, equal pressure is applied to both ends of the hydraulic cylinder, with the effect that the net thrust delivered by the cylinder rod will be the same as if the effective pressure were applied only to the rod cross-sectional area (i.e., thrust=system pressure×rod area). The oil redirected by the regenerative circuit from the rod end of the cylinder, fills an equivalent volume on the blind or cap side of the cylinder so that the hydraulic pump driving the cylinder needs to only fill a space equivalent to the volume of the rod. Such regenerative principles are well known to those skilled in the art.

While such known regenerative principles have been employed to advantage in reducing hydraulic cylinder cycle time, they have typically been employed to assist movement of the piston in only one direction and have typically only directly used a portion of the hydraulic fluid available for redirection. Further, the hardware that has been used to implement regenerative control functions has typically been very large, bulky, heavy, expensive and difficult to install. The ability to decrease cylinder movement cycle time is proportional to the volume of hydraulic oil that can be redirected by the regenerative circuit. However, due in part to the heretofore cumbersome implementation techniques of known regenerative control circuits, they have not been able to practically, effectively and efficiently handle regeneration applications for very large cylinders wherein it is desirable, for example, to redirect significant quantities of oil through oil passageways of greater than 1 inch in diameter.

The present invention addresses the above-described deficiencies of regenerative systems of the prior art. The present invention provides a relatively inexpensive, efficient and effective regenerative circuit that can be made with readily available technology and which gives significant cycle reduction time by enabling virtually 100% regenerative cylinder operation in both directions of travel of the cylinder's piston. These and other features of the invention will become apparent upon a more detailed description thereof.

SUMMARY OF THE INVENTION

This invention provides a hydraulic system particularly suitable for rapidly moving the piston of a primary hydraulic cylinder in both directions of travel by use of a regenerative valve member. The regenerative transfer of hydraulic fluid from one side of the piston to the other is accomplished by the regenerative valve without requiring the transferred fluid to be directed through the master control valve of the system which determines the direction of travel of the piston. The regenerative principles of this invention enable rapid movement of the piston in both directions of travel.

According to one aspect of the invention there is a provided a regenerative hydraulic control apparatus comprising: (a) a primary hydraulic power unit having a piston movable within a cylinder and dividing the cylinder between a blind side and a rod side; (b) a rod connected to the piston for motion therewith and longitudinally extending through the rod side; (c) a force imparting apparatus for applying force to the piston through the rod; (d) a regenerative valve having first and second chambers respectively operatively connected to the blind and the rod sides of the hydraulic power unit, and a movable member relative to the first and second chambers for selectively opening and closing fluid flow between the first and second chambers and through the valve; (e) a master valve suitable for operative connection with a pump and a reservoir and operatively connected to the primary power unit and to the regenerative valve for directing movement of the primary hydraulic power unit piston in its cylinder; and (f) wherein the regenerative valve provides regeneration fluid flow between the rod and the blind sides of the primary hydraulic power unit for both directions of travel of the piston. According to a further aspect of the invention the force imparting apparatus comprises a weight, and may include a ram member such as ram used in the crushing of objects. According to yet another aspect of the invention, the force imparting apparatus could comprise a bias member as, for example, a spring. According to a further aspect of the invention, the regenerative valve includes a pilot port operatively connected with the master control valve for controlling operation of the regenerative valve between its open and its closed states. According to yet a further aspect of the invention, a metering valve may be connected to the pilot port for regulating the length of time for transitioning the regenerative valve between its open and its closed modes of operation.

According to yet a further aspect of the invention, there is provided a method of providing regenerative drive fluid flow for a hydraulic control unit of the type having a primary hydraulic cylinder operatively connected to a master control valve that activates and controls the direction of travel of a piston within the primary hydraulic cylinder, comprising the steps of: (a) connecting a regenerative hydraulic control network to the primary hydraulic cylinder; (b) selectively causing the piston to cyclically move between retracted and power strokes; and (c) moving regenerative hydraulic fluid through said regenerative hydraulic control network from one side of the piston to the other during both the retracted and the power stroke movements of the piston. According to yet a further aspect of the invention, the transfer of regenerative fluid from one side of the piston to the other does not require flow of such fluid through the master control valve, but only through the regenerative hydraulic control network. The regenerative method principles of this invention can be applied to move a ram member, and particularly to such a ram member that is used in association with crushing items.

According to yet a further aspect of the invention, there is provided a hydraulic apparatus comprising: (a) a reservoir of hydraulic fluid; (b) a pump connected to the reservoir; (c) a primary hydraulic cylinder having a moveable piston; (d) a master control valve hydraulically connected to the pump, the reservoir, and the primary hydraulic cylinder to selectively control the direction of movement of the piston; and (e) a regenerative valve hydraulically connected with the primary hydraulic cylinder and the master control valve for transferring hydraulic fluid from one side of the piston to the other during movement of the piston, in both longitudinal directions thereof. These and other features of the invention will become apparent to those skilled in the art upon a more detailed description of several embodiments of the invention.

BRIEF DESCRIPTION OF THE DRAWING

Referring to the Drawing, wherein like numerals represent like parts throughout the several views.

DETAILED DESCRIPTION OF THE INVENTION

The invention includes an improved regenerative control valve construction and its associated regenerative control circuit. To assist in a description of the invention, it will be described in association with one preferred application for its use (i.e., in an automobile crushing apparatus). While such apparatus provides a striking example of how this invention enhances the operation of such apparatus, it will be understood that the invention is not to be limited to such application. The regenerative valve and circuitry of this invention is applicable to any application requiring a hydraulic prime mover, wherein it is desired to minimize the operative cycle time of such prime mover. Further, while the present invention will be described in association with an automobile crushing apparatus of a type wherein a heavy ram is lifted by the prime mover hydraulic cylinder(s), which ram provides a load or force to the rod of the prime mover cylinder(s), it will be understood that such load could be provided by alternative means such as, for example and not in a limiting way, spring or bias forces, hydraulic forces, electric motor produced forces, or other electric motor or mechanical forces. Further, while a particular configuration and shape of a regenerative valve will be disclosed, it will be understood that the invention is not to be limited by any unclaimed particulars of the regenerative valve apparatus. With the above in mind, the invention will be described below in association with its preferred application with an automobile crushing apparatus.

Figure 1:
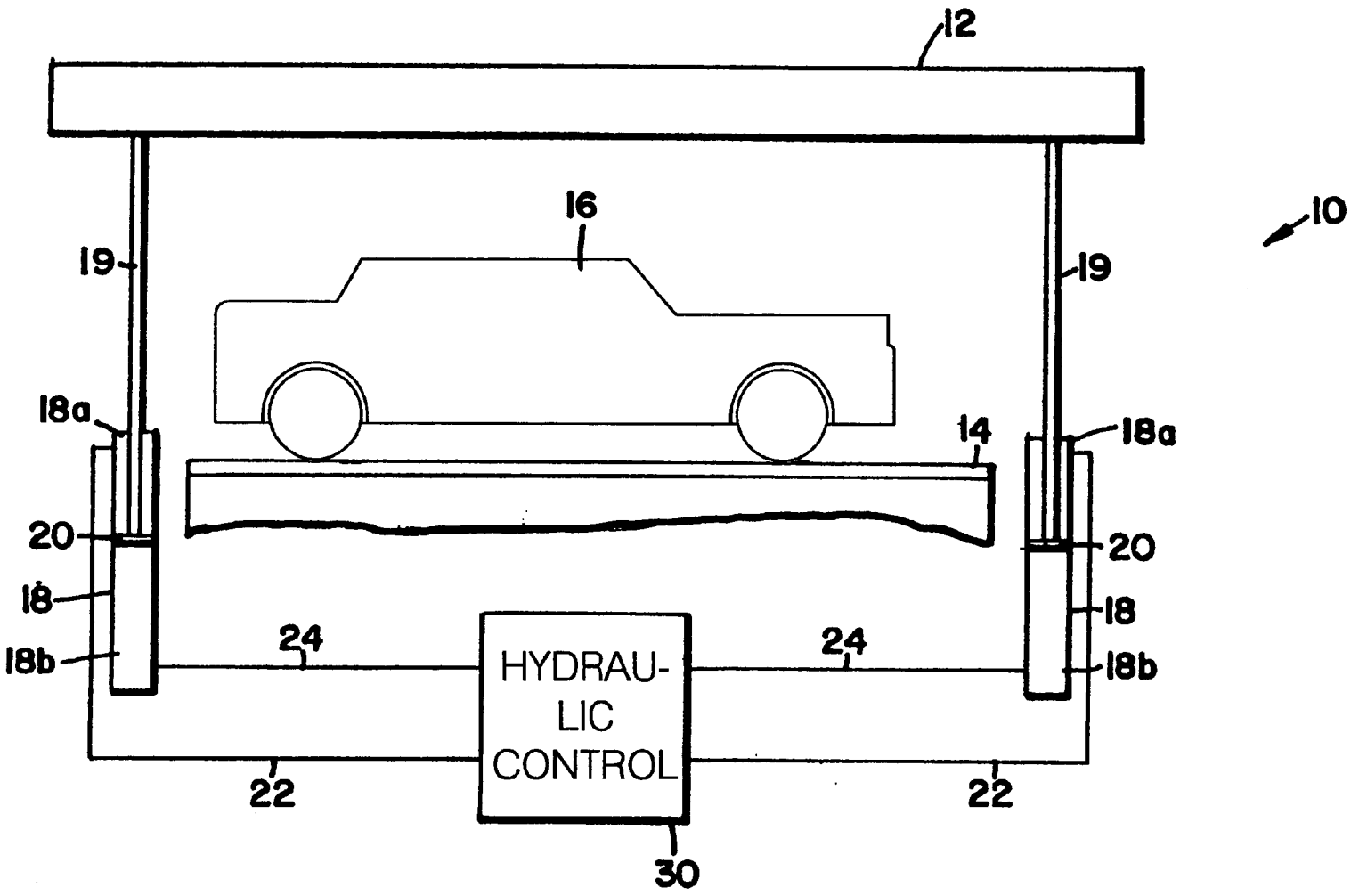
FIG. 1 is a diagrammatic view depicting a hydraulic automobile crushing apparatus of a type to which the principles of this invention apply.

Referring to FIG. 1, a diagrammatic view of a hydraulic automobile crushing system to which the present invention may apply is schematically illustrated at 10. The automobile crushing system could be of any type well known in the art as for example the type illustrated in the Williams (U.S. Pat. No. 3,757,680) or Allbritton (U.S. Pat. No. 3,844,209). In general, such systems include some type of a flattening head or ram 12 which is moveable toward and away from a fixed platform or bed 14 on which the item to be crushed (e.g., automobile) 16 is placed. As the flattening head or ram 12 moves toward the fixed platform 14, the automobile is crushed therebetween. In a preferred configuration of such automobile crushing apparatus, the flattening ram may weigh between 15,000–30,000 pounds. The ram is movably supported by extendible rod portions 19 of a plurality of ram control cylinders 18. The movable rods 19 are operatively connected to pistons 20 that travel within the ram control cylinders 18 in a manner well known in the art. The pistons divide the ram control cylinders into two portions. The upper portion of each cylinder is referred to as the "rod" side (18*a*) of the cylinder; and the lower portion of the cylinder is referred to as the "blind" or "cap" side (18*b*) of the cylinder. The relative volumes of the rod and blind sides of the cylinder 18 change as the piston 20 moves within the cylinder. Hydraulic oil is provided to the rod side 18*a* of the cylinder 18 from a hydraulic control network 30 by means of a rod side hydraulic supply line 22; and hydraulic oil is supplied to the blind side 18*b* of the cylinder 18 from the hydraulic control network 30 by means of a blind side hydraulic supply line 24.

In a preferred embodiment configuration of an automobile crushing system 10 generally configured as illustrated in FIG. 1, with ram control cylinders rated at 3,000 PSI and having a 10 inch diameter piston 20 and a 4 inch diameter rod 19 with a 96 inch stroke and a 50 gallon per minute pump without practicing the principles of this invention, is would take approximately 39.17 seconds to move the piston the full travel of its stroke in the upward direction so as to lift the ram 12. Similarly, without employing the principles of this invention, the described crushing apparatus would take approximately 32.9 seconds for the ram control cylinders 18 to move in the downward direction over their full cylinder stroke during a automobile crushing operation. Using the principles of this invention, as described in more detail hereinafter, such raising and lowering times are respectively reduced to 6.27 seconds and 3 seconds (an 8 times decrease in overall cycle time).

Figure 2:
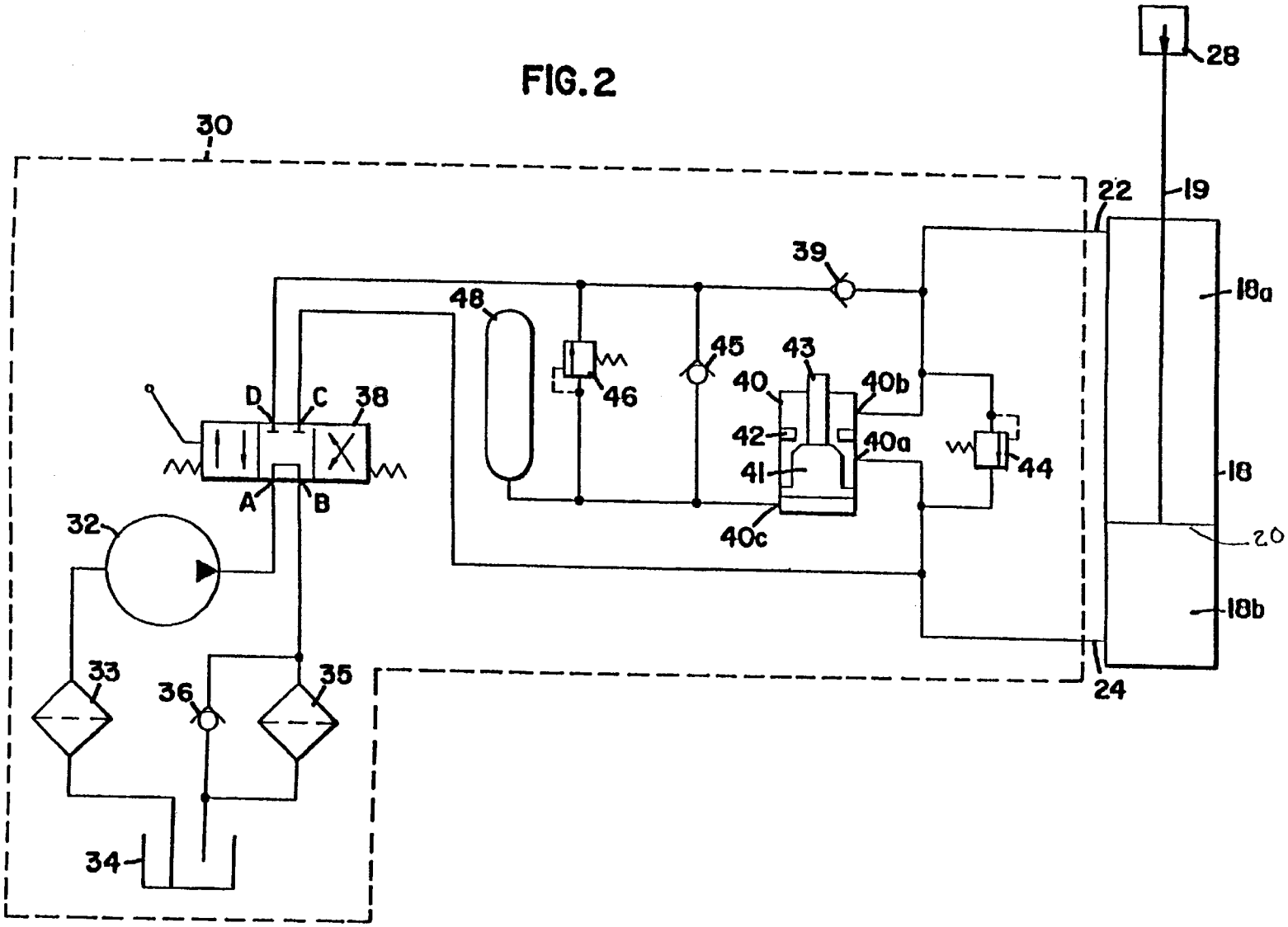
FIG. 2 is a hydraulic schematic diagram of one embodiment of the present invention that could be used with a system as disclosed in FIG. 1.

A hydraulic schematic diagram of one embodiment of a regenerative control network of the present invention is illustrated in FIG. 2. Referring thereto, a double acting ram control cylinder is indicated at 18, with its movable rod 19, and its rod and blind sides 18*a* and 18*b* respectively indicated. The load or force supported by the rod 19 is generally indicated at 28 and would, in the automobile crushing system 10 described above, represent the weight or force of the flattening head or ram 12 that is supported by the movable rod 19. The ram control cylinder 18 is operatively connected to the hydraulic control network 30 by means of the rod side hydraulic supply line 22 and the blind side hydraulic supply line 24.

The hydraulic control network 30 includes a pump, 32 such as a gear pump or other appropriate pump connected to draw hydraulic oil from a tank or reservoir 34 through a suction screen 33. A return line is provided to the reservoir 34 through a return filter 35, connected in parallel with a check valve 36. The gear pump and reservoir return lines are connected to a first pair of ports "A" and "B" of a four-way directional control valve 38. The directional control valve 38 also has a second pair of ports labeled as "C" and "D". The directional control valve 38 may be of any appropriate valve construction and is in the preferred embodiment a proportional valve having manual or solenoid activation, or could be formed as a pilot operated valve, that operates to block its outlet ports "C" and "D" from one another and from the pump and tank connected ports "A" and "B" when in its neutral position.

The blind side hydraulic supply line 24 is directly connected to the "C" port of the control valve 38, and the rod side hydraulic supply line 22 is connected by means of a check valve 39 to the "D" port of the control valve 38.

The blind side hydraulic supply line 24 is also connected to a first port 40*a* of a regenerative valve 40. The regenerative valve 40 also has a second port 40*b* that is directly connected to the rod side hydraulic supply line 22. The regenerative valve 40 (as hereinafter described in more detail) has a piston 41 and rod configuration similar in nature to the prime mover ram control cylinder 18 in that the rod 43 extends through the valve housing as the piston 41 moves within the regenerative valve housing. The piston 41 moves within the regenerative valve cylinder housing toward and away from engagement with an annular seat member (generally indicated at 42) to open and close the fluid passageway between the first and second ports 40*a* and 40*b* of the regenerative valve. The regenerative valve also has a pilot port 40*c* which provides hydraulic fluid communication to the blind or cap side of the regenerative valve's piston 41.

A pressure relief valve 44 is connected across the first and second ports 40*a* and 40*b* of the regenerative valve 40. The pilot port 40*c* of the regenerative valve 40 is connected by means of a check valve 45 to the "D" port of the directional control valve 38. The pilot port 40*c* is also connected by means of a pressure relief valve 46 to the "D" port of the control valve 38, and is also connected to an accumulator 48.

The regenerative valve 40 is illustrated in the FIG. 2 schematic diagram in an "open" position which allows fluid flow between the rod side and blind side hydraulic supply lines to the primary cylinder 18. The regenerative valve closes when the system pressure and pilot pressure are equal, or when the system pressure is zero. The regenerative valve opens when the pilot pressure applied to the regenerative valve is from about 15% to 25% less than the system pressure. The basic principle of operation is that when there is equal pressure on both sides of the piston 20 of the primary cylinder 18, the piston will move to "extend" the rod 19 (in the upward direction as viewed FIG. 2). Pressure in the blind side 18*b* portion of the cylinder 18 is equal to the "piston area" times the "pressure" within the blind side portion of the cylinder. Pressure applied to the top portion of the piston 20, in the rod side 18*a* of the cylinder 18 is equal to the "piston area minus rod area" times the "pressure" within the rod side chamber. Therefore, when the "pressure" is equal in both the rod side and blind side chamber cavities, the piston will move toward the rod side, (i.e., in an upward direction as viewed in FIG. 2) as a result of a force equal to the "cross-sectional area" of the rod 19 times the "system pressure".

The accumulator 48 connected to the pilot port 40*c* of the regenerative valve 40 acts as a biasing means to keep the regenerative valve closed when there is little or no oil pressure in the primary system. Alternatively other bias means such as a spring (not illustrated) or the network embodiment to be hereinafter described with respect to FIG. 5 could be used for this purpose. The check valve 45 allows oil into the system and the relief valve 46 holds the oil in the system at pressure, thereby allowing the accumulator to hold a reserve of oil (under pressure) at the pilot port.

When the control valve 38 is positioned to "extend" the ram cylinder 18, port "C" of the control valve is open such that oil flows into the blind side hydraulic supply line 24. Simultaneously, port "D" of the control valve is now open to the reservoir 34. Since there is a check valve 39 on the rod side hydraulic supply line (i.e., return line) from the cylinder 18, oil is not allowed back to the reservoir. This forces the oil from the rod side 18*a* of the cylinder 18 to flow into the second port 40*b* of the regenerative valve 40. The regenerative valve's pilot port 40*c* drains into port "D" of the control valve which is at zero pressure. In the preferred embodiment illustrated, The regenerative valve check and relief valves 45 and 46 respectively will hold approximately 750 PSI in the pilot port 40*c*. The fluid pressure entering the second port 40*b* of the regenerative valve is greater than the pilot pressure, and forces the valve to open as illustrated in FIG. 2, allowing oil to flow through the regenerative valve from its second port 40*b* through the regenerative valve and out of its first port 40*a* to the blind side hydraulic supply line 24 and into the blind side 18*b* of the cylinder 18. With oil flowing to both sides of the ram cylinder 18, the regeneration has started and the cylinder will extend with a force equal to the cross sectional area of the rod 19 times the pressure within the rod and blind sides of the cylinder (i.e., the "system pressure").

In the example illustrated for the preferred embodiment cylinder 18, the cylinder 18 begins with 27.42 gallons of hydraulic fluid in the rod side portion of the cylinder. During the regeneration process, 5.22 gallons are added (i.e., the volume displacement of the rod) from the pump, to the 27.42 gallons from the rod side of the cylinder, which is forced through the regenerative valve to the bottom or blind side of the cylinder. At a pumping rate of 50 gallons per minute, it takes approximately 6.27 seconds to pump the 5.22 gallons. Without the regeneration, as stated earlier in the discussion, it would take 39.17 second to extend the cylinder. The unique configuration of the regenerative valve enables extremely large flow rates through the regenerative valve, which is not found in previously known regenerative valve systems. Further, the redirected hydraulic oil is not run back through the control valve during the regenerative process, but is fully redirected to the blind side of the primary cylinder maximizing efficiency of the process.

The system also allows for regeneration during the retraction movement portion of the ram cylinder. The regenerative process in reverse is enabled by the same regenerative valve 40 with the assistance of the external load 28 and the system's ability to control the time it takes to close the regenerative valve 40. The retraction process is briefly described below. The regenerative valve 40 is still open after extending the ram cylinder 18. The cylinder 18 will not retract while the control valve 38 is closed, since to retract would cause a net reduction of 5.22 gallons in the ram cylinder. With the ram cylinder fully extended there is (in a preferred embodiment) approximately 15,000 pounds of weight on the cylinder rod 19. Because of this weight pushing down on the rod, there is greater pressure in the blind side of the cylinder than in the rod side of the cylinder. When the control valve 38 is opened to begin a retraction process, the control valve places oil into port "D" from the pump 32 and opens port "C" to the reservoir 34. With the control valve providing an open fluid flow path to the reservoir, the load or weight 28 pushing down on the rod 19 forces oil out of the blind side of the cylinder into the blind side hydraulic supply line 24 and through the open regenerative valve to the rod side of the cylinder, with the excess 5.22 gallons flowing back to the tank or reservoir. With the regenerative valve open, not only can the excess oil from the ram cylinder 18 go to the reservoir, but the oil from the pump also goes back to the reservoir. Since the circuit is open to the reservoir, there is no system pressure. With no pressure in the system, the regenerative valve will close, using the pressure in the accumulator 48. By adjusting the accumulator pressure and the relief valve pressure, the time it takes to open and close the regenerative valve can be selected and varied.

With the regenerative valve closed, the pump 32 is now pumping oil into port "D" which is connected to the rod side of the cylinder 18 and which also connects to the regenerative valve's pilot port 40*c*. With equal oil pressure now on the top and the bottom of the regenerative valve, the regenerative valve will remain closed since there is greater surface area on the bottom of the valve piston 41. The force holding the regenerative valve closed is equal to the regenerative valve pressure times the cross-sectional area of the regenerative valve rod 43. The system now works normally, with port "D" of the control valve pressurizing the rod side of the cylinder 18 and with oil from the blind side of the cylinder 18 flowing back to the reservoir through port "C" of the control valve.

In the preferred embodiment configuration, the cylinder 18 moves to its fully retracted position in approximately 3 seconds with the primary cylinder 18 and the regenerative valve 40 pushing approximately 640 gallons per minute out of the bottom of the cylinder 18. Without the regenerative valve, the oil flow from the cylinder would normally proceed at a 50 gallons per minute rate, which is the output rate parameter for the pump, providing a normal retraction period of 32.9 seconds. Therefore, with the combined increased efficiency of the regenerative circuit, an eight-fold decrease in the cycle time is achieved, with regeneration being accomplished in both the extension and retraction portions of the cycle.

Figure 4:
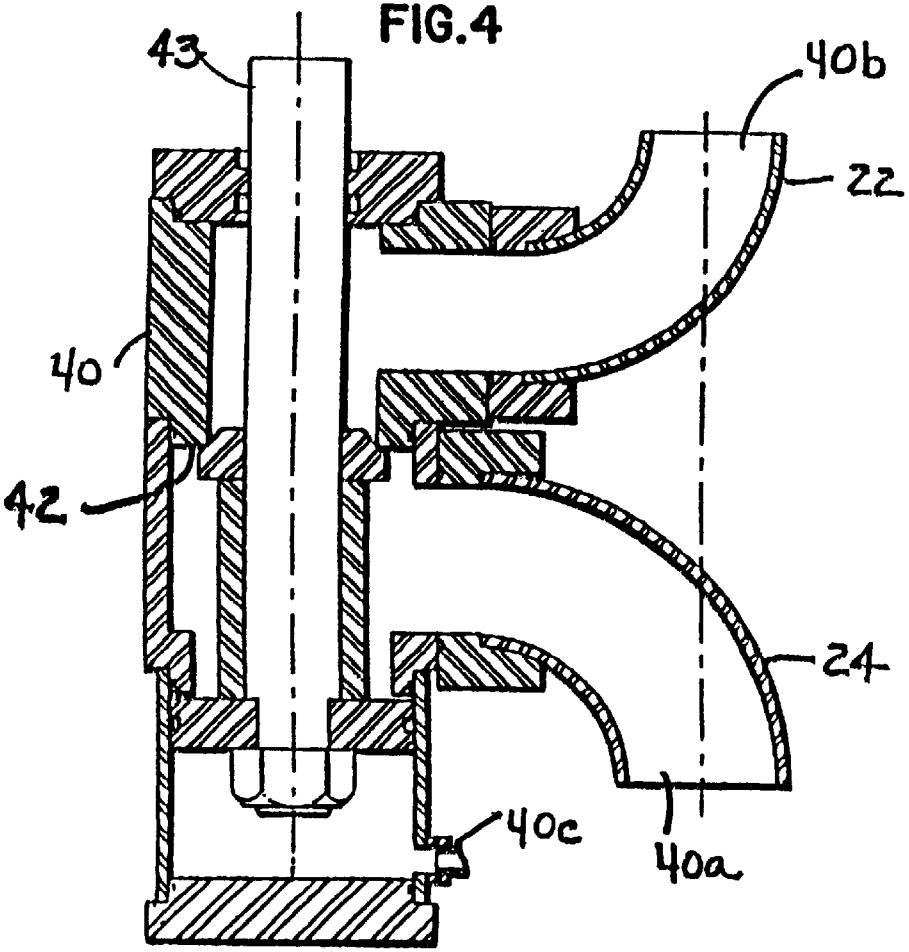
FIG. 4 is a diagrammatic cross-sectional view of the regenerative valve apparatus of FIG. 3, with its piston illustrated in a closed position.
Figure 3:
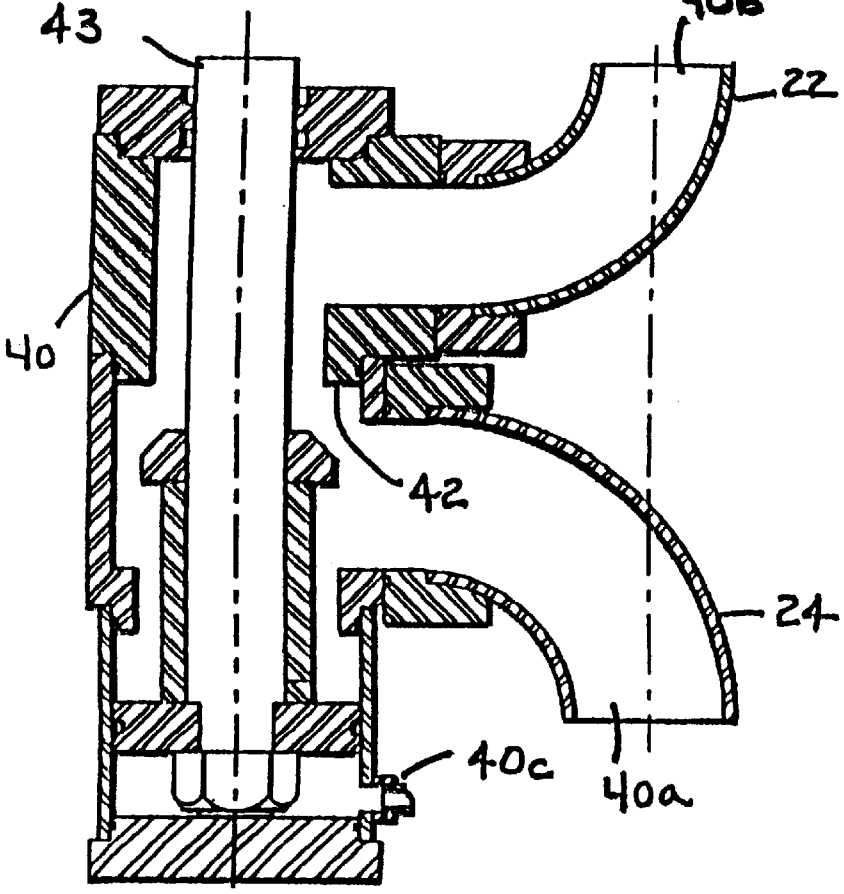
FIG. 3 is a diagrammatic cross-sectional view of one embodiment of a regenerative valve apparatus used in the embodiment of FIG. 2, with its piston illustrated in an open position.

In a preferred configuration implementation of the regenerative valve, indicated in FIGS. 3 and 4, the regenerative valve includes a similar extendible rod implementation configuration as the primary valve 18. This implementation allows for significant size reduction and simplicity in the valve construction and for the handling of enormous fluid flow rates through the regenerative valve. In a preferred embodiment configuration of the regenerative valve, the inside diameter of the cylinder in which the regenerative piston 41 rides is 4 inches, and the outside diameter of the regenerative cylinder rod 43 is 2 inches. The regenerative valve design of the invention enables the use of very large inlet and outlet port dimensions for the valve. In the preferred embodiment, the upper port 40*a* has a diameter of 2.5 inches and the lower port 40*b* has a diameter of 3 inches, dimensions that have been unattainable with prior art regenerative techniques and which provide for rapid redirection of very large volumes of hydraulic fluid.

Figure 5:
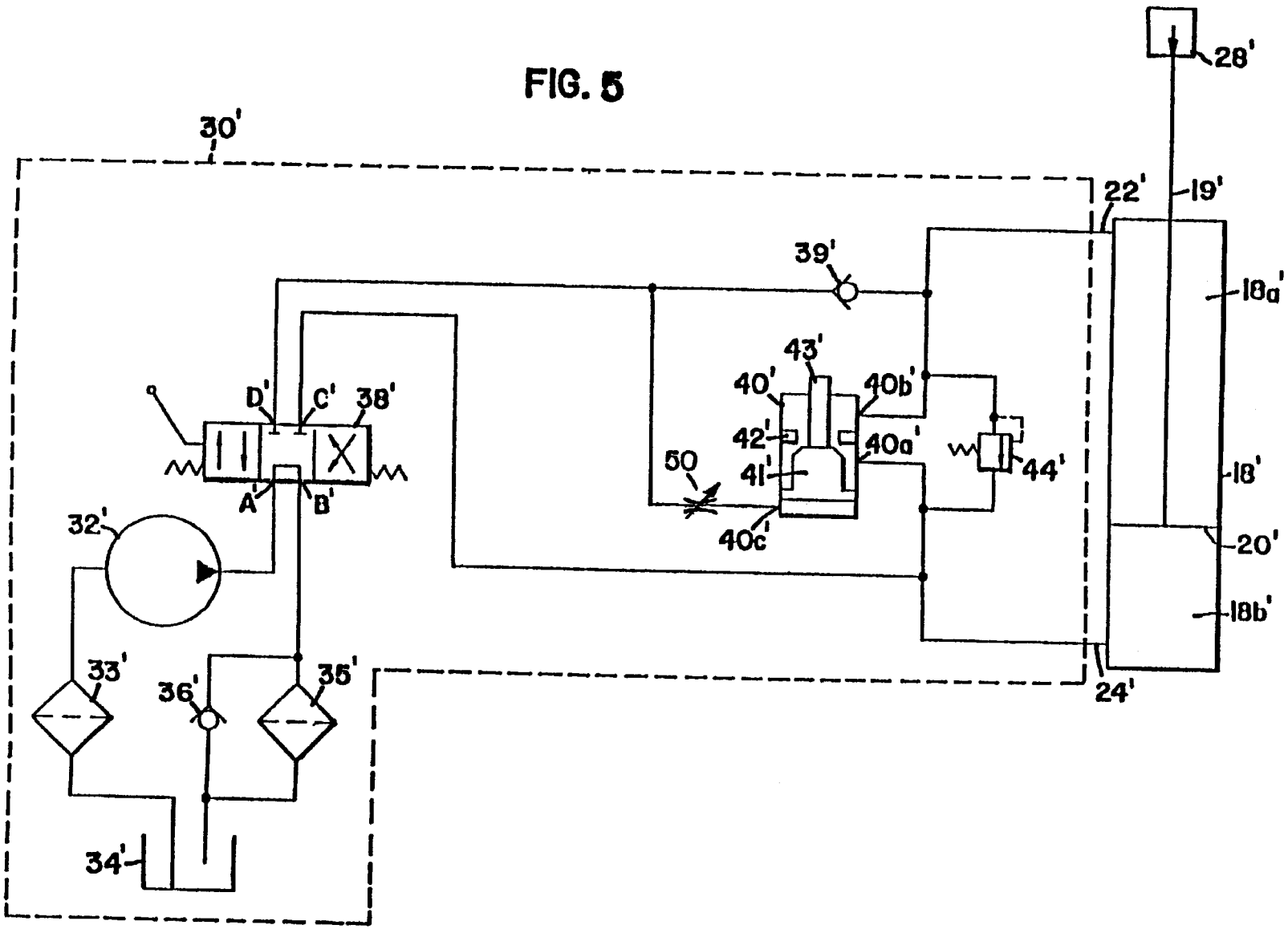
FIG. 5 is a hydraulic schematic diagram of an alternative embodiment of the present invention that could be used with a system as disclosed in FIG. 1.

An alternative embodiment of the hydraulic network of FIG. 2 is illustrated in FIG. 5. The FIG. 5 embodiment eliminates the accumulator 48, the check valve 45 and the relief valve 46 of the FIG. 2 embodiment and incorporates a metering valve 50 that connects the pilot port 40*c'* to the D' port of the directional control valve 38'. It will be noted that all elements of the FIG. 5 network that are common to the FIG. 2 network have been designated by the same numbers as in FIG. 2, with an added "prime" designation. The metering valve 50 functions to allow free fluid flow in the direction out of the pilot port 40*c'* and to meter or restrict fluid flow into the pilot port 40*c'* from the D' port of control valve 38'. The metering valve includes an adjustment member, as is well known in the art, allowing adjustment of the fluid flow rate through the valve and into the pilot port.

When the control valve 38'is positioned to "extend" the ram cylinder 18', the pilot port 40*c'* drains through the metering valve 50, through port D' of the control valve 38' to the reservoir 34'. The rest of the extension operation is the same as previously described for the FIG. 2 network embodiment, with the regenerative valve 40' opening to enhance the extension process by rapidly allowing all of the oil from the rod side 18*a'* of the cylinder 18' to flow to the cylinder's blind side 18*b'* through the regenerative valve 40'.

When the control valve 38' is positioned to operate the cylinder 18' in a retraction mode, as previously described with respect to the FIG. 2 network embodiment, the regenerative valve 40' is initially in an open position. Oil pressure is applied through port D' of the control valve 38' through the check valve 39' and to the rod side hydraulic supply line 22'. The check valve 39' provides some initial back pressure to the metering valve 50. A line restriction at valve 39' or other appropriate means known to those skilled in the art could also be used to provide the desired back pressure. Simultaneously, the C' port of valve 38' is connected to the reservoir 34' as well as to the 40*a'* port of the valve 40' and the blind side supply line 24' of cylinder 18'. As the oil flows from the cylinder 18' blind side 18*b'*, through the open regenerative valve 40', and to the cylinder rod side 18*a'*, pressure will also begin to rise at the metering valve 50 which will begin to close the regenerative valve 40'. By controlling the rate of flow through the metering valve 50 into the pilot port 40*c* of the regenerative valve 40', the closing time for valve 40' can be accurately controlled.

It will be appreciated from the foregoing that the principles of this invention provide for an improved hydraulic control system using a regenerative valve apparatus and method for significantly reducing the operative cycle time of a prime mover hydraulic cylinder. The reduced time applies to movement of the hydraulic cylinder piston in both directions of travel (i.e. to its "power" stroke and to its "return" stroke). The simplicity and improved construction of the regenerative valve portion of the system enables virtually 100% redirection and use of the hydraulic fluid passing from the rod side of the cylinder, to its blind side during a power stroke. During a return stroke the regenerative valve system allows rapid transfer of all the hydraulic fluid required by the rod side of the hydraulic cylinder from its blind side, and rapid return to the reservoir of any excess fluid. The simplicity of the system provides for high reliability, relative efficient and cost-effective implementation and for easy installation for either newly designed hydraulic control systems or for retrofitting of existing control systems.

While the invention has been described with respect to preferred embodiments thereof, and with respect to specific types of components and materials used therein in association with and particular sized components and hydraulic operative parameters, it will be understood by those skilled in the art that the invention is not to be limited in any manner by the specifics of either the described embodiments, materials, component sizes or operative parameter valves. Such embodiments, materials, sizes and parameter valves have been described to indicate clear examples of how the principles of the invention can be specifically applied to a hydraulic control system. All alternatives and modifications of the foregoing are intended to be covered within the broad scope of the appended claims.

What is claimed is:

1. A regenerative hydraulic control apparatus comprising:

(a) a primary hydraulic power unit having a piston moveable within a cylinder and dividing the cylinder between a blind side and a rod side;

(b) a rod connected to said piston for motion therewith and longitudinally extending through said rod side;

(c) a force imparting apparatus for applying force to said piston through said rod;

(d) a regenerative valve having first and second chambers respectively operatively connected to said blind and said rod sides of said hydraulic power unit, and a moveable member movable relative to said first and said second chambers for selectively opening and closing fluid flow between said first and said second chambers and through said valve, said regenerative valve including a pilot port opening into a third chamber of said regenerative valve, said pilot port opening being operatively connected to said master control valve by a first check valve;

(e) a master control valve suitable for operative connection with a pump and reservoir and operatively connected to said primary power unit to determine the direction of movement of said piston in said cylinder relative to said blind and said rod sides, a rod side hydraulic supply line with a second check valve connecting said rod side of side primary power unit and said master control valve; and (f) wherein said regenerative valve provides regenerative fluid flow between said rod and said blind sides of said primary hydraulic power unit for both directions of travel of said piston.

2. The control apparatus of claim 1, wherein said force imparting apparatus comprises a weight.

3. The control apparatus of claim 2, wherein said force imparting apparatus comprises a ram member.

4. The control apparatus of claim 1, wherein said force imparting apparatus comprises a bias member.

5. The control apparatus of claim 1, wherein said regenerative valve is configured to provide substantially all regenerative fluid flow between said blind and said rod said primary hydraulic power unit.

6. The control apparatus of claim 1 wherein said first check valve is adapted to block fluid flow from said pilot port opening to said master control valve.

7. The control apparatus of claim 1 wherein said second check valve is adapted to block fluid flow from said rod side of said primary power unit to said master control unit via said rod side hydraulic supply line.

8. The control apparatus of claim 1 additionally comprising an accumulator connected to said pilot port opening of said regenerative valve for biasing the regenerative valve toward closing fluid flow between said first and said second chambers.

9. A regenerative hydraulic control apparatus comprising:

(a) a primary hydraulic power unit having a piston movable within a cylinder and dividing the cylinder between a blind side and a rod side;

(b) a rod connected to said piston for motion therewith and longitudinally extending through said rod side;

(c) a force imparting apparatus for applying force to said piston through said rod;

(d) a regenerative valve having first and second chambers respectively operatively connected to said blind and said rod sides of said hydraulic power unit, and a moveable member movable relative to said first and said second chambers for selectively opening and closing fluid flow between said first and said second chambers and through said valve;

(e) a master control valve suitable for operative connection with a pump and reservoir and operatively connected to said primary power unit to determine the direction of movement of said piston in said cylinder relative to said blind and said rod sides; and (f) wherein said regenerative valve provides regenerative fluid flow between said rod and said blind sides of said primary hydraulic power unit for both directions of travel of said piston;

wherein said regenerative valve includes a pilot port opening into a third chamber of said regenerative valve, said pilot port opening being operatively connected to said master control valve;

wherein a metering valve is operatively connected between said pilot port and said master control valve, said metering valve allowing unrestricted fluid flow out of said pilot port and metered fluid flow into said pilot port.

10. The control apparatus of claim 9, wherein said metering valve includes an adjustment device to selectively control the rate of fluid flow through the valve and into the pilot port.

11. The control apparatus of claim 10, wherein the control apparatus is arranged and configured such that the rate of fluid flow through the metering valve is directly related to the time required to move said moveable member of the regenerative valve from a fully open to a fully closed position.

12. A method of providing regenerative drive fluid flow for a hydraulic control unit of the type having a primary hydraulic cylinder operatively connected to a master control valve that activates and controls the direction of travel of a piston within said primary hydraulic cylinder, comprising the steps of:

(a) providing a regenerative hydraulic control network having a regenerative valve having first and second chambers, and a moveable member movable relative to said first and said second chambers for selectively opening and closing fluid flow between said first and said second chambers and through said valve, said regenerative valve including a pilot port opening into a third chamber of said regenerative valve, said pilot port opening being operatively connected to said master control valve;

(b) connecting the regenerative hydraulic control network to said primary hydraulic cylinder;

(c) selectively causing said piston to cyclically move between retracted and power strokes;

(d) moving regenerative hydraulic fluid through said regenerative hydraulic control network from one side of the piston to the other during both said retracted and said power strokes; and (c) metering fluid flow into said pilot port opening and allowing unrestricted fluid flow out of said pilot port opening.

13. The method of claim 12, wherein said hydraulic fluid moved through said regenerative hydraulic control network does not pass through said master control valve.

14. The method of claim 13, including the steps of:

providing a ram member; and operatively connecting said ram member for movement with said piston.

15. The method of claim 14, further including the step of connecting said ram member to a crushing apparatus for crushing items by said ram member during said piston power stroke.

16. The method of claim 12, further including the step of applying a mechanical force to said piston to assist in its movement during said retracted stroke.

17. A hydraulic apparatus comprising:

(a) a reservoir of hydraulic fluid;

(b) a pump connected to said reservoir;

(c) a primary hydraulic cylinder having a longitudinally moveable piston;

(d) a master control valve hydraulically connected to said pump, said reservoir and said primary hydraulic cylinder, to selectively control the direction of movement of said piston;

(e) a regenerative valve hydraulically connected with said primary hydraulic cylinder and said master control valve for transferring hydraulic fluid from one side of said piston to the other during movement of said piston, in both longitudinal directions thereof, said regenerative valve having a pilot port opening, and (f) a metering valve operatively connected between said pilot port and said maser control valve, said metering valve allowing unrestricted fluid flow out of said pilot port opening and metered fluid flow into said pilot port opening.

18. The hydraulic apparatus of claim 17, wherein said regenerative valve is separate from said master control valve.

19. The hydraulic apparatus of claim 18, wherein said regenerative valve is configured to direct substantially all of said transferred fluid of said primary hydraulic cylinder.

* * * * *